US011903462B2

(12) United States Patent
Granito

(10) Patent No.: US 11,903,462 B2
(45) Date of Patent: Feb. 20, 2024

(54) BAND CLASP COMPRISING A DEVICE FOR ADJUSTING THE LENGTH OF THE BAND FOR A COMFORTABLE SETTING

(71) Applicant: Dexel SA, Bienne (CH)

(72) Inventor: Elio Granito, Tüscherz-Alfermée (CH)

(73) Assignee: DEXEL SA, Bienne (CH)

( * ) Notice: Subject to any disclaimer, the term of this patent is extended or adjusted under 35 U.S.C. 154(b) by 0 days.

(21) Appl. No.: 17/691,218

(22) Filed: Mar. 10, 2022

(65) Prior Publication Data

US 2022/0295951 A1 Sep. 22, 2022

(30) Foreign Application Priority Data

Mar. 18, 2021 (EP) ..... 21163516

(51) Int. Cl.
*A44C 5/24* (2006.01)

(52) U.S. Cl.
CPC ..... *A44C 5/246* (2013.01)

(58) Field of Classification Search
CPC ..... A44C 5/246; A44C 5/24; Y10T 24/2155; Y10T 24/4782
See application file for complete search history.

(56) References Cited

U.S. PATENT DOCUMENTS

| | | | | |
|---|---|---|---|---|
| 2,065,581 | A * | 12/1936 | Heileman | A44C 5/246 24/71 J |
| 2,588,655 | A * | 3/1952 | O'Neill | A44C 5/246 24/71 J |
| 8,001,658 | B2 * | 8/2011 | Christian | A44C 5/246 24/71 J |
| 8,789,245 | B2 * | 7/2014 | Leger | A44C 5/246 24/71 J |
| 2013/0160255 | A1 * | 6/2013 | Schmidt | A44C 5/246 24/71 J |
| 2015/0366303 | A1 * | 12/2015 | Pier | A44C 5/246 24/71 J |
| 2020/0405018 | A1 * | 12/2020 | Granito | A44C 5/246 |

FOREIGN PATENT DOCUMENTS

| | | | |
|---|---|---|---|
| CH | 594380 | A | 1/1978 |
| CH | 705058 | B1 | 12/2012 |
| CN | 104544791 | A | 4/2015 |

* cited by examiner

*Primary Examiner* — Robert Sandy
*Assistant Examiner* — Rowland Do
(74) *Attorney, Agent, or Firm* — Robert C. Netter, Jr.; Dann, Dorfman, Herrell & Skillman

(57) ABSTRACT

A clasp for bands with a device for adjusting the length is provided, wherein the adjustment device has a pivotally arranged member, and wherein the member can be activated by a user in order to activate the length adjustment. Preferably, the pivoting element is part of the clasp cover. Preferably, the pivoting element is articulated by means of axes that correspond to the shafts of the pushers of the clasp-locking mechanism.

24 Claims, 10 Drawing Sheets

BAND CLASP COMPRISING A DEVICE FOR ADJUSTING THE LENGTH OF THE BAND FOR A COMFORTABLE SETTING

TECHNICAL FIELD

The present invention relates to a clasp for a band, in particular for a wrist watch, the clasp having a device for adjusting the length of the band, preferably in a quick and simple manner, without opening the clasp, permitting an immediately comfortable setting. The invention also relates to a folding clasp and to a wrist watch comprising such a clasp.

STATE OF THE ART AND PROBLEMS FORMING THE BACKGROUND TO THE INVENTION

Bands for wrist watches usually have means to adjust the length of the band. For example, in the case of leather or plastic bands, the free end of one of the two strands of the band comprises a series of holes distributed along the longitudinal extension of the band. The free end of the other strand of the band has a connecting device, such as a pin clasp, used to join the two strands by inserting the pin into the hole corresponding to the desired length. In the case of metal link bands, the length of the band is adjusted by removing or adding a link to one or both strands of the band. However, in both cases, the possible adjustments to the useful length of the band are quite approximate and the perimeter of the watch wearer's wrist may lie between two adjacent adjustments.

The state of the art has clasps for wrist watches that allow fine adjustment of the length of the band. Such a fine adjustment is desirable to precisely adapt the length of the band to the wrist of the wearer of a wrist watch. On the other hand, as raised in EP 2361523, the size of a wearer's wrist can vary with changes in temperature, for example.

Many clasps with a mechanism for fine adjustment of length are known to be state of the art. These mechanisms include a blocking or locking device or member to prevent unintentional or accidental lengthening and/or shortening. In many clasps, the aim is to prevent unintentional lengthening in particular, as the risk of unintentional shortening is lower. On the other hand, the possibility of being able to shorten the band quickly, without the need to activate a release mechanism and thus without opening the clasp, is even desirable for the wearer, as this possibility allows the band to be tightened around the wrist easily and at any time. For example, a user can always tighten the wristband around their wrist by using their free hand to apply pressure to a strand of the band in the appropriate direction. European patent EP2875747B1 shows a clasp that allows the length of the band to be reduced finely by exerting a force on a strand of the band that is attached to a moving part. However, this clasp includes a locking device with a tooth to ensure that the movable part is held in a predefined position. In order to lengthen the band, the user is obliged to open the clasp and press down on a bearing surface in order to release the tooth and move the movable part in the direction corresponding to a lengthening of the band. The construction of the clasp shown in EP2875747B1 is relatively simple compared to other clasps with a mechanism for fine adjustment of the length of the band. Nevertheless, it may be desirable to further reduce the complexity of the mechanism and further reduce the number of parts.

It is one aim of the present invention to use basic parts of the clasp to assign a function to them in the context of fine tuning. For example, one or more parts that are already present in the clasp could be used as a component of the fine-tuning mechanism, thereby reducing the number of parts in the clasp. One aim is therefore to have as many of the functions of the fine-tuning device as possible fulfilled by parts that are part of the clasp anyway.

One aim of the invention is to avoid and limit the presence of several separate, prominent and/or visible activation members for the wearer of the clasp, taking into account that the closing mechanism of the clasp generally already requires the arrangement of an actuating member such as a pusher to open the clasp. One aim is to implement a simple-looking clasp that does not suggest a sophisticated mechanism.

One aim of the present invention is to facilitate length adjustment in both directions, not just in the direction of shortening the band, while minimising the risk of accidental and unintentional length changes.

Several patent documents disclose clasps with a fine adjustment comprising an activation member arranged to be able to pivot upon activation by a user, for example EP2875747B1, EP3170420B1, CH707483A2, U.S. Pat. No. 2,596,186 and CH700230A2. EP1908366A1 discloses a clasp with a fine-adjustment device comprising a rack arranged in the clasp cover. None of these clasps achieves the above aims.

One aim of the invention is to use a locking mechanism similar to that disclosed in EP0913106A1. In this clasp, two parallel legs of an unfolding arm are arranged to be able to move towards each other to disengage locking members to allow the clasp to be opened.

One aim of the invention is to provide the wearer of a wrist watch with the function of an immediate adjustment to a comfortable length at any time, without the need to open the clasp or to remove the wrist watch from the wrist.

SUMMARY OF THE INVENTION

The present invention relates to a clasp with a device for fine adjustment of the useful length of the band, enabling the useful length to be extended.

In one aspect, the invention relates to a clasp having a device for adjusting the useful length of the band, the said device for adjusting the useful length comprising: a movable part and a support, the movable part being arranged to enable a displacement with respect to the said support during length adjustment, and comprising an activation member arranged to be able to pivot with respect to the said support, one of the said movable part and of the said activation member comprising a locking member and the other comprising an indexing member, the said locking member being intended to be positioned in a notch of the indexing member, in order to determine a discrete and stable value of the length of the band.

In one aspect, the invention relates to a wrist watch having a clasp according to the first aspect of the invention.

In one embodiment, the movable part is housed in the support.

In one embodiment, the clasp comprises a cover comprising or formed by at least two parts, one of the two parts being the activation member and the other being the said support.

In one embodiment, the activation member is arranged to be activated by lifting the upper wall of the cover and/or at least a part of the upper wall of the cover. The upper wall of the cover preferably comprises an outer surface which is visible to the wearer of a wrist watch with the clasp.

In one embodiment, the activation member is integrated into and/or forms an integral part of the clasp cover.

In one embodiment, the clasp comprises a pivot axis enabling the said activation member arranged to be able to pivot with respect to the said support.

In one embodiment, the said pivot axis forms part of at least one actuating member of a closing mechanism of the clasp.

In one embodiment, the said at least one actuating member comprises at least one pusher connected to the said pivot axis.

In one embodiment, the actuating member being arranged to move linearly along an orthogonal axis and/or co-axially or in parallel to the pivot axis of the said activation member with respect to the said support device. Preferably, this movement is carried out by the actuating member when the latter is activated in order to open the clasp.

In one embodiment, the linear movement of the actuating member is a translational movement. Preferably, the displacement follows the longitudinal axis of the said actuating member or follows an axis that is parallel to it.

In one embodiment, the clasp comprises an actuating member arranged to allow opening of the clasp by the actuation of the said actuating member, the said actuating member comprising and/or constituting a pivot axis for the said actuating member of the of the device for adjusting the useful length.

In one embodiment, the clasp comprises at least one resilient element, preferably biasing means, such as one or more springs, arranged to bias the activation member and the support device towards each other and/or to counteract pivoting of the activation member with respect to the support device.

In one embodiment, the said resilient element is arranged in a housing of the support, to act on a rod or screw anchored in the upper wall of the cover, or in at least a part of the said wall, the said upper wall preferably forming part of the activation member.

In one embodiment, the housing of the said resilient element comprises a hole or bore arranged in the said support, the said hole or bore preferably extending in a substantially radial direction and/or extending in a bottom-up direction.

In one embodiment, the activation member comprises a pair of side holes and a top plate or wall, each of the said side holes serving as a pin support and/or pivot guide for the said activation member. The lateral holes, preferably extending in a transversal direction, are preferably arranged through ears, or lateral extensions, of the said activation member.

Preferably, these ears extend in substantially longitudinal and radial planes, for example parallel to the plane of symmetry of the clasp, if such a plane of symmetry is present. Preferably, the ears are arranged substantially perpendicular to the top plate of the cover and/or a top plate of the said activation member.

In one embodiment, the activation member is a transversal element of the clasp cover, which connects side faces of the cover.

In one embodiment, the said ears, or extensions, form a part and/or extension of the side walls of the cover and/or the support that forms part of the cover.

In one embodiment, the said support has a pair of side holes, preferably aligned and/or co-axial with the side holes of the activation member, each of the said side holes serving as a guide for a pivot axis for the said activation member, preferably a side hole of the support and a side hole of the activation member form a bearing for a pivot axis.

In one embodiment, the movable part comprises a carriage housing the said locking member so as to allow the said locking member to perform a translational movement in order to be able to cooperate with an indexing member arranged in the upper wall.

In one embodiment, the upper wall of the cover is segmented in longitudinal direction into several successive parts or segments, the said activation member forming a segment or part of the said upper wall.

In one embodiment, the said support comprises two side walls preferably comprising guide rails arranged to allow the sliding of the moving part.

In one embodiment, the side walls of the support and the extensions and/or ears of the actuating member together form at least part of the side walls of the cover. Preferably, the lugs are arranged as an extension of at least part of the side walls of the support. Preferably, the outer faces of the lugs and the side walls of the support together create at least part of the outer side walls of the cover, as visible to the user wearing the clasp, for example.

In an embodiment, is a folding clasp comprising a folding arm, said folding arm being pivotally connected with said support and/or with said activation member.

In an embodiment, an axis of rotation of said activation member with respect to said support coincides with an axis of rotation of said support and/or of said activation member with respect to said folding arm.

The clasp is preferably arranged to allow length adjustment without the need to open the clasp and/or the need to remove the wrist watch from the wrist. The clasp thus allows for an immediate adjustment to a comfortable length in all circumstances, due to the simplicity of the gesture required to shorten and/or lengthen the band.

Other aspects of the invention and preferred embodiments and implementations are defined in the claims and in the following description.

BRIEF DESCRIPTION OF THE DRAWINGS

The characteristics and advantages of the invention appear more clearly on reading the following description of a preferred embodiment, the description being given merely by way of non-limiting example, and with reference to the accompanying diagrammatic drawings, in which.

DESCRIPTION OF THE EMBODIMENTS

Figure 1:
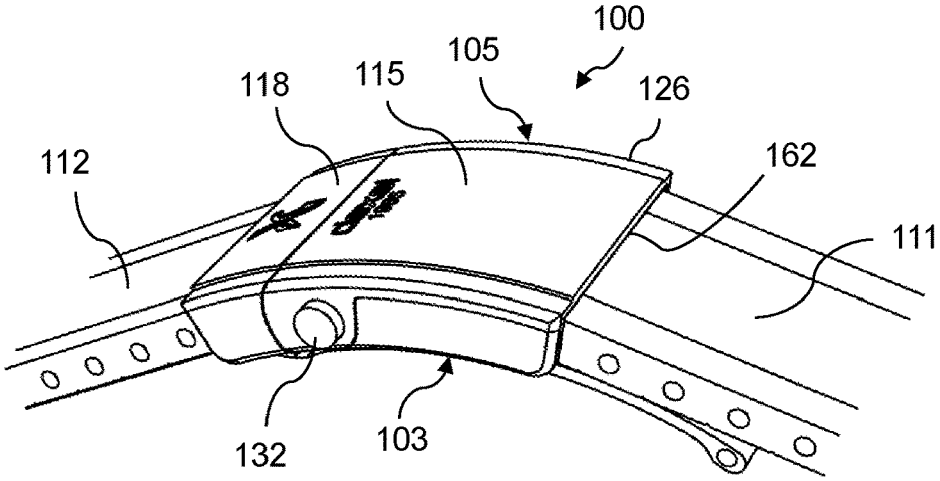
FIG. 1 is a perspective view of a clasp according to a first embodiment of the present invention, shown in the closed position.

The clasps illustrated in the figures correspond to preferred embodiments of the present invention. In particular, the clasps shown are of the folding clasp type and are intended in particular to be fitted to watch bands. The bands may be of any type, such as, for example, in flexible plastic material, in leather, or be constituted by an assembly of metal links.

In general, clasps comprising a device for fine adjustment of the useful length of a band comprise at least two parts arranged so as to be able to perform a relative movement in the longitudinal direction with respect to each other. Each of the two parts comprises an attachment member for a first and second strand of the band respectively. The relative displacement done by the two parts causes the attachment members to move closer together or further apart and thus shortens or lengthens the useful length of the band.

In this description, one of the two parts arranged to be movable with respect to the other is referred to as the "moving part", and the other of the two parts is referred to as the "support", the "support device" or the "frame". Since it is a relative movement, the identification of the "movable part" is a matter of arbitrary convention. Generally, the smaller of the two parts is referred to as the movable part, while the other part often contains the mechanism for closing and opening the clasp, for example in the form of hinged blades. Alternatively, in the context of the present invention, the "movable part" could be called the "first movable part" and the "support" could be called the "second movable part", the first and second movable parts being capable of relative displacement in the longitudinal direction.

Typically, the movable part and the support cooperate by means of, firstly, an indexing member, such as for example a series of notches, a rack, and/or a toothing, and, second, a locking member or blocking structure, for example a jaw, a tooth or a lock, intended to cooperate with the indexing member in order to determine discrete values of useful length.

The difference in length between the discrete values is determined by the spacing between the notches of the indexing member. The spacing between the notches is generally shorter than the spacing between two holes of a band strand used with a pin clasp, or the distance defined by a link of a metal band, which is why the length-adjustment device of the invention allows fine and/or precise adjustment of the length of the band. In one embodiment, the distance between successive notches is 0.4 mm, preferably 0.3 mm, more preferably 0.2 mm, for example between 0.05 and 1.5 mm.

A discrete and stable value corresponds to a concrete position, defined by the position of a notch in which the locking member is held, so that its position with respect to the indexing member is stabilised, locked and/or stopped, by the interaction of the locking member and the rack in the absence of an external force.

The clasp illustrated in FIGS. 1-4E comprises a cover formed from at least two main parts, a frame or support 103 and a lid 105. A particularity of the illustrated embodiment is that the locking member 106 is associated with the movable part 102, while the indexing member 107 is associated with the activation member 105 of the fine-adjustment device. This member 105 is articulated on the support 103.

FIGS. 5 to 12B show embodiments in which the two structures, the indexing member and the locking member, are arranged in reverse, i.e. the locking member is associated with the support 203 via the activation member 205, while the indexing member 207, 307 is associated with and thus integral with the movable part 202, 302. Generally speaking, the indexing member is preferably integral with the structure with which it is associated, either with the support (or the activation member) or with the moving part, as the case may be. The locking member is arranged on the other of the two structures, so as to be able to generate cooperation between the two structures.

The clasps 100 shown in FIGS. 1-12B, besides a device for fine adjustment of the useful length of the band, have a conventional "clasp" function, which is described in detail in patents EP 0913106B1 and EP2875747B1, issued in the name of the Applicant.

These conventional functions of the clasp will be described hereafter in brief with the example of the clasp 100 shown in FIGS. 1-4B. The clasp 100 is intended to be connected to two strands of a band 111, 112 in a known manner. The clasp 100 comprises a base 1, elongated in the longitudinal direction of the band and slightly curved over at least part of its length to better match the shape of a wearer's wrist.

The expressions "direction of the length of the band", "longitudinal direction of the band", "orthogonal", "transversal", "radial", "vertical", "top", "bottom", "below" and "above" are known to the skilled person. The definitions given in document WO2019/166671A1, page 9, line 13 to page 10, line 13, apply to this description.

The clasps shown in FIGS. 1-12B are substantially symmetrical and therefore have a plane of symmetry that extends in the direction of the length of the band.

Figure 4B:
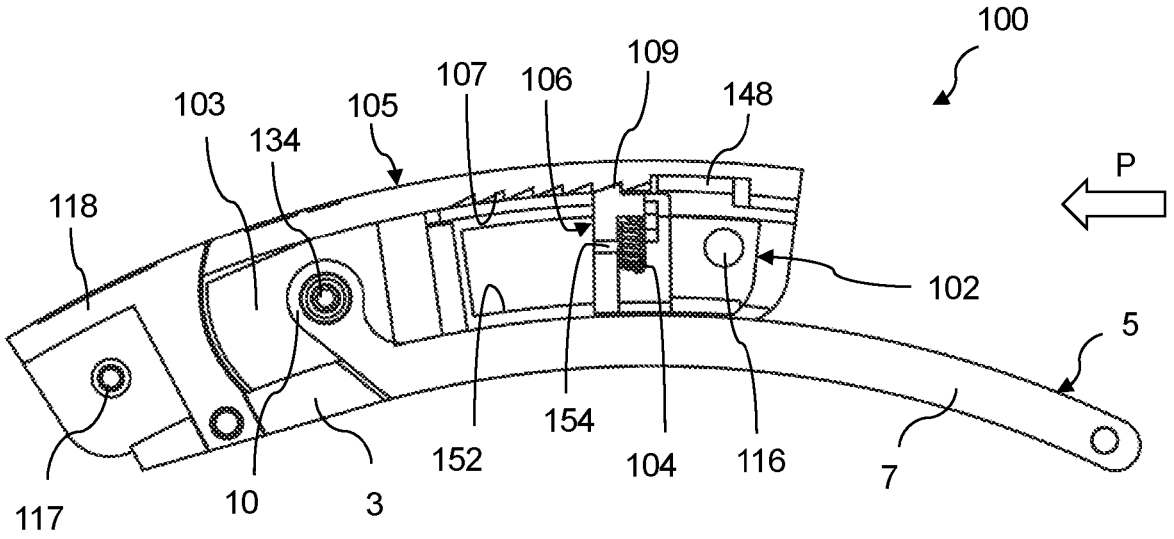
FIGS. 4B, 4C and 4D are longitudinal sectional views along A-A of FIG. 4A, in which the fine adjustment mechanism is in the resting (FIG. 4B, 4C) and activated (FIG. 4D) positions respectively.

The terms "bottom" and "top" generally refer to the bottom and top respectively of the clasp as shown in FIG. 4B.

Figure 3:
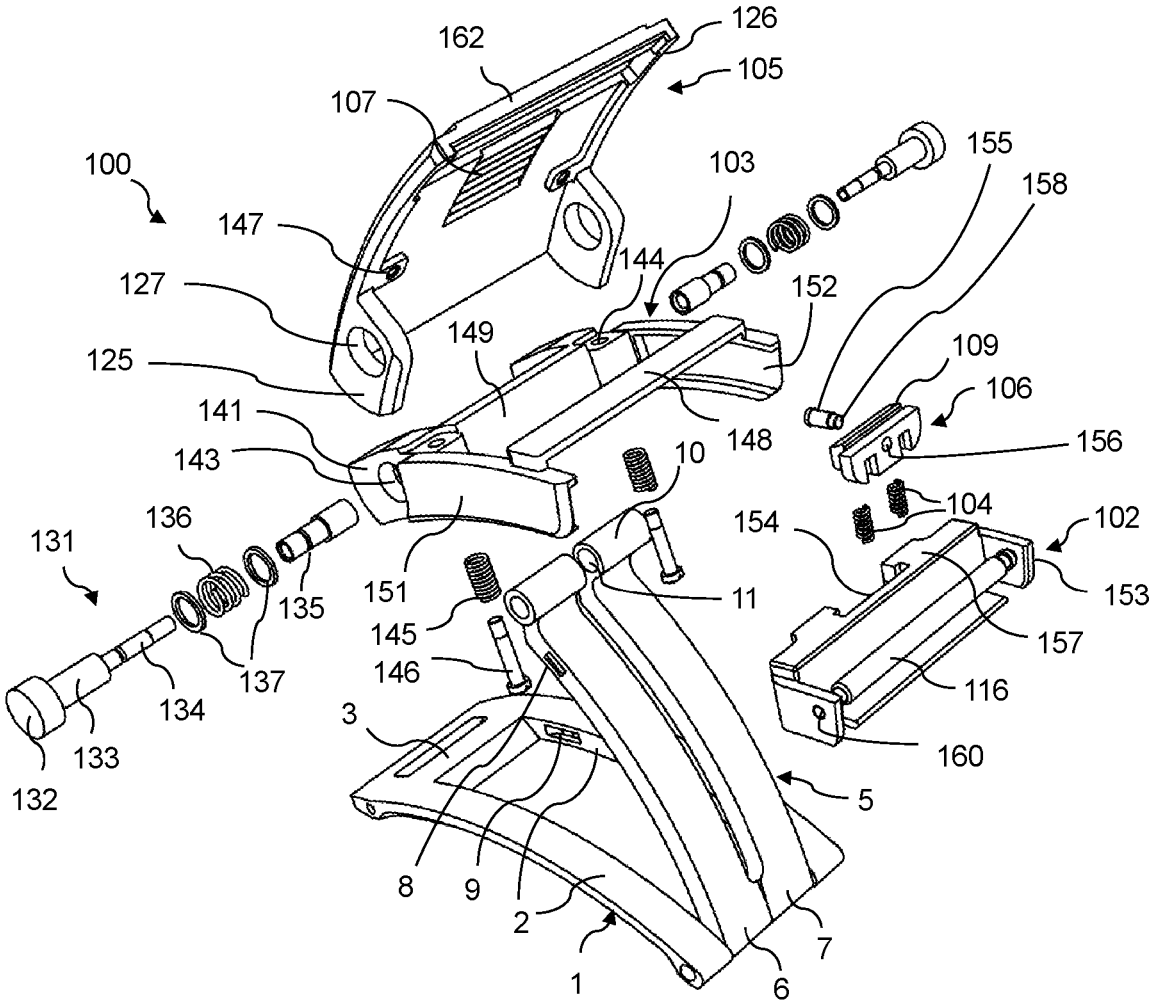
FIG. 3 is an exploded perspective view of the clasp of FIGS. 1-2.
Figure 5:
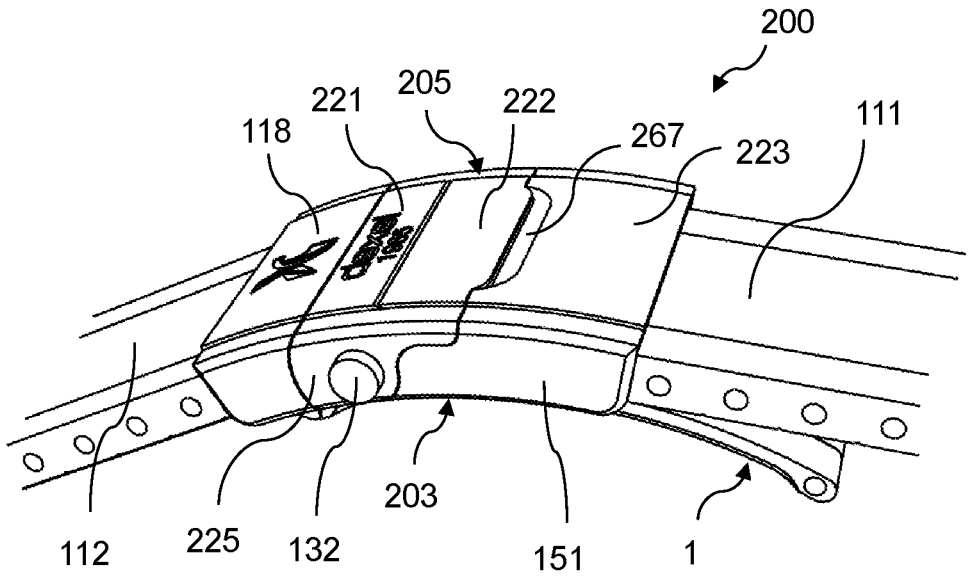
FIG. 5 is a perspective view of a clasp according to a first embodiment of the present invention, shown in the closed position.
Figure 9:
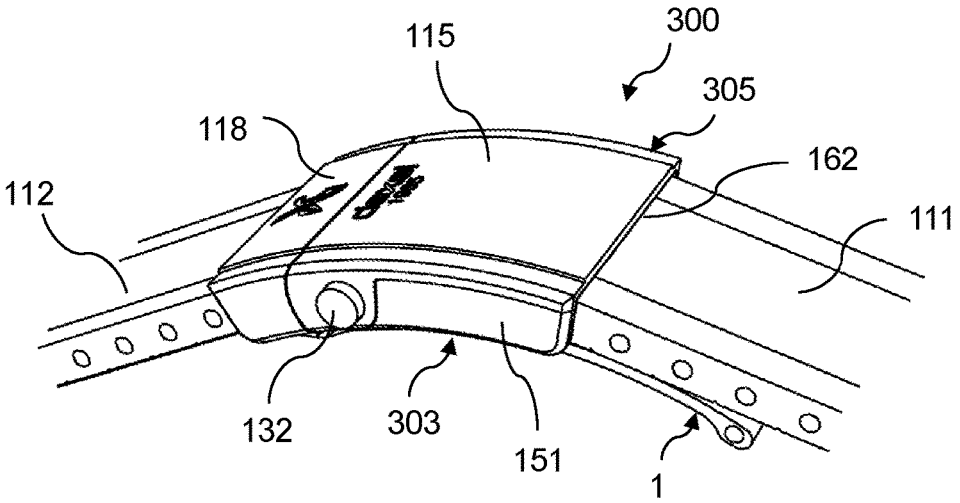
FIG. 9 is a perspective view of a clasp according to a first embodiment of the present invention, shown in the closed position.
Figure 10:
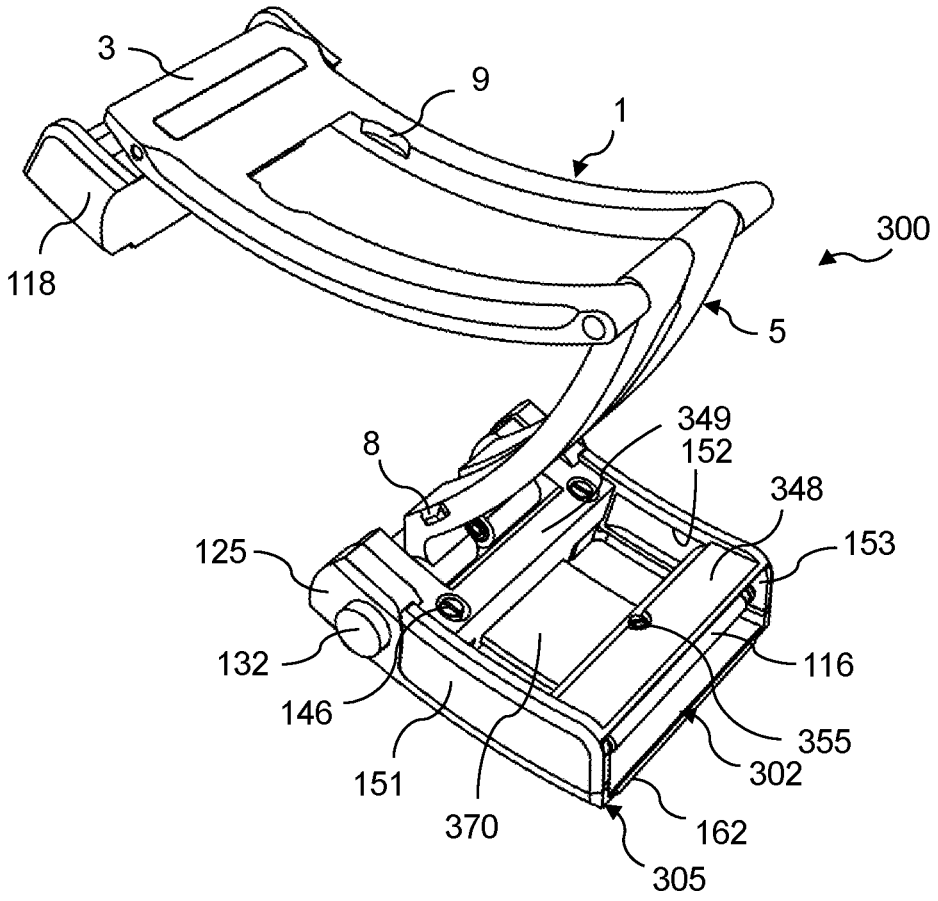
FIG. 10 is a perspective view from below of the clasp of FIG. 9 in the open position.
Figure 11:
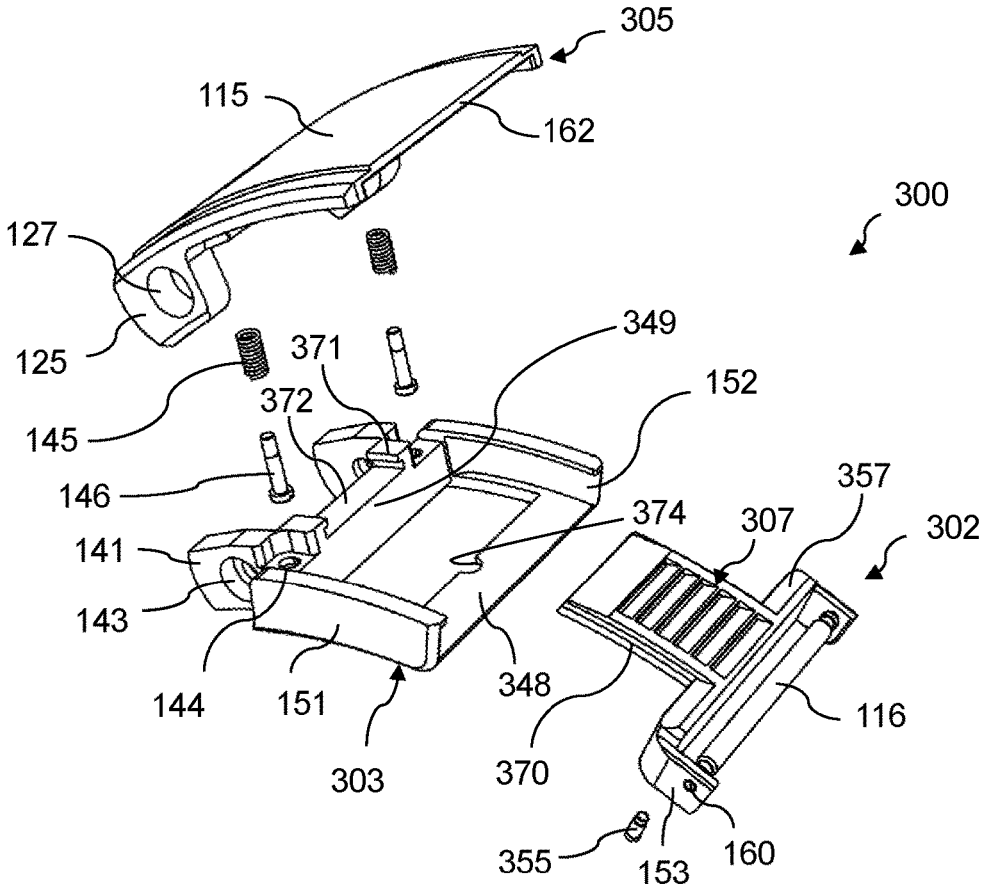
FIG. 11 is an exploded perspective view of the clasp cover of FIGS. 9-10.

As shown in FIG. 3, the base 1 of the folding clasp comprises two integral longitudinal members 2 spaced apart by a transversal spacer 3 arranged at a first end of the longitudinal members 2. An attachment member intended to be connected to a free end of the band, by means of a bar or rod 117 (FIG. 4B), is rigidly connected with the transversal spacer 3. In the present description, the attachment member carried by the crosspiece 3 corresponds to a second attachment member intended to be connected to a second band strand 112, the first attachment member 116 being connected to the movable part 102 as described below. In the embodiments shown, the second attachment member is arranged in a cover 118, rigidly connected to the first end of the base 1. The cover 118 is shaped so that it forms an extension of the cover 103, 105 when the clasp is closed, so that the clasp as a whole has a homogeneous and/or compact external appearance, as seen in FIGS. 1, 5 and 9.

A folding arm 5 consisting of two legs 6 and 7 is mounted at the opposite end of the longitudinal members 2 in a conventional manner. The opposite ends of the arms 6, 7 have barrels 10, each with a hole 11.

In the embodiment shown, the folding arm 5 comprises first and second extremities, the folding arm being pivotally connected to said base at or close to said first extremity and pivotally connected with said support 103 and/or said activation member 105 at or close to said second extremity.

The pair of holes 11 is provided to ensure the assembly of the folding arm 5 with the cover 103, 105, by means of two lateral pushers 132 each made integral with a rod 134 engaging in the corresponding hole 11, with the interposition of a bush 135.

Springs 136 are interposed between the cover 103, 105 and each of the pushers 132 to exert a restoring force on the latter tending to keep them away from each other.

The pushers 132 are arranged so that they act on the legs 6, 7 to bring them closer together when they are operated by a user wishing to open clasp 100. When the legs 6, 7 are brought together, claws 8 on the legs 6, 7 are released and inserted into complementary recesses 9 in the base 1, as described in detail in EP 0 913 106 B1.

Washers 137 may also be provided to define stable bearing surfaces on either side of the springs 136.

As already mentioned, the device for adjusting the useful length of the band according to the invention is associated with a cover 103, 105 preferably consisting of a lid 105 and a support 103.

The cover 105 has a plate 126 which forms at least part of the upper wall of the cover. In the embodiments shown in FIGS. 1-4B and 5-12B, the cover forms the entire upper wall 126 of the cover. Two lateral through holes 127 are arranged to extend along a substantially orthogonal axis in the cover, preferably in lateral ears 125, preferably arranged towards a first end of the cover 105. The upper wall 126 has an outer surface 115, visible to the wearer of the wrist watch with the clasp (FIG. 1).

The support 103 has two side walls 151 which extend substantially in the longitudinal direction and which are joined together by two transversal spacers 148, 149. The walls 151 are preferably slightly curved along at least part of their length, like the base 1. Towards the first end, the support 103 has two lateral extensions or protrusions 141, with a through hole 143 arranged in each of the two extensions. When the clasp 100 is assembled, cylinders 133 of each of the two actuating members 131 pass through the lateral through holes 127, 143 of the cover 105 and the support 103 respectively. The pairs of holes 127 and 143 thus together form a pair of bearings for two pivot axes formed by the two cylinders 133. As the holes 127, 143 are arranged laterally on either side of the support and cover 105, there is a bearing for each of the lateral actuating members 131, the latter each comprising a pusher 132, as described above.

The cover-support assembly 103, 105 is hinged to the folding arm 5 by means of the rods 134 of the actuating members as described above. The cover 105 is also hinged to the frame 103 so that it can pivot with respect to the frame 103, with the two cylinders 133 forming the pivot axis.

Figure 4C:
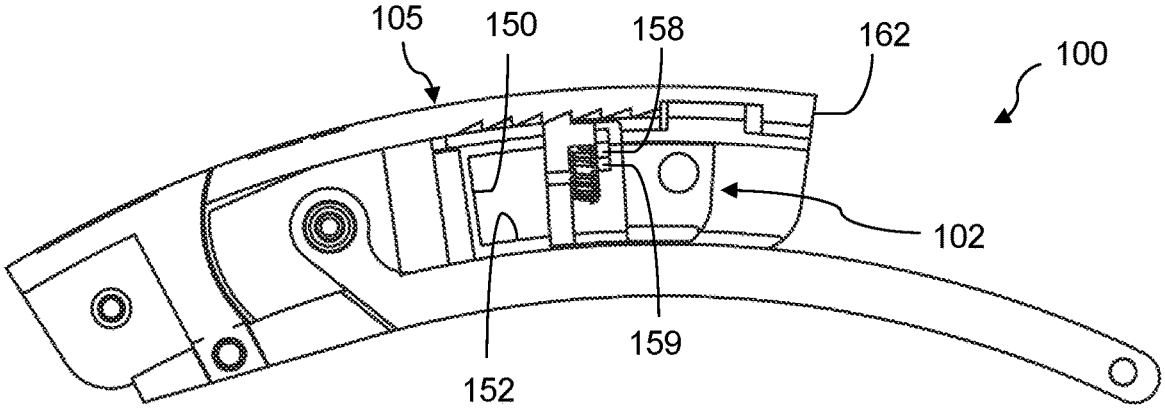
Figure 4D:
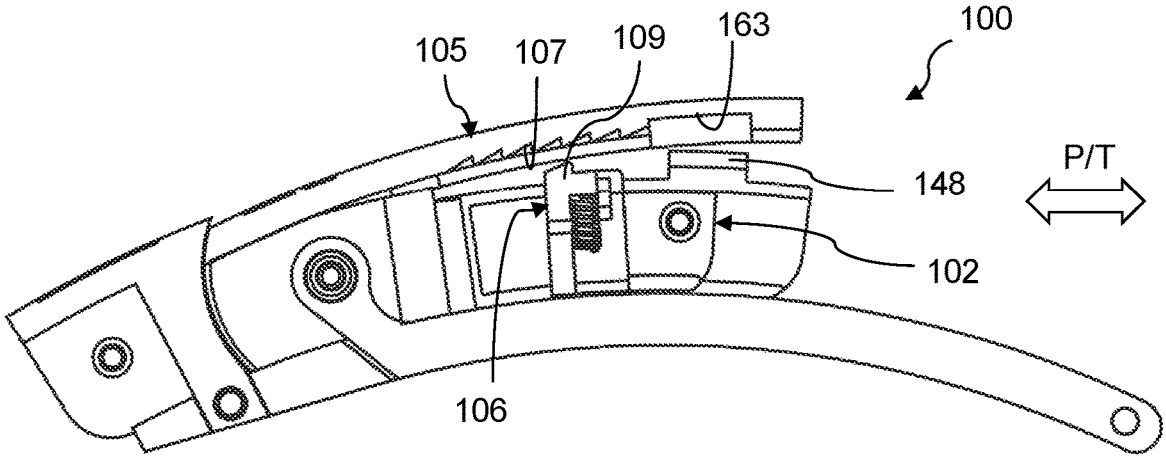
Figure 4E:
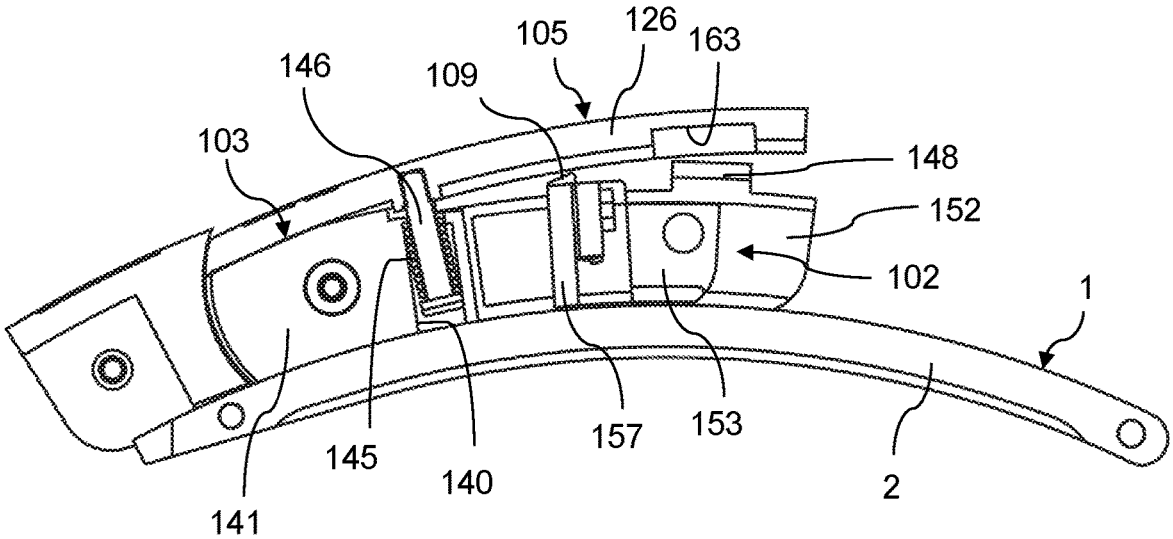
FIG. 4E is a longitudinal sectional view along B-B of FIG. 4A.

As can be seen in FIG. 4E, helical compression springs 145 are arranged in housings 140 formed by holes in protrusions of the frame 103. Two screws 146 are also arranged to pass inside the two springs and through openings 144 provided for this purpose in the frame 103 in the extension of the housings 140. The ends of the screws 146 are anchored in threaded holes 147 provided in the cover 105. Each spring 145 is supported on the one hand on the head of the screw 146 on which it is fitted, and on the other hand on a shoulder created in the spring housing, so as to return the cover 105 towards the support 103. In the absence of a force acting on the cover 105 so as to be able to pivot it to push it away from the support 103, the assembly formed by the support 103 and the cover 105 has the appearance of a conventional clasp cover, as seen in FIG. 1.

The side walls 151 of the support 103 each have a guide rail 152 on the inside of the wall. In the embodiment shown, the guide rails 152 comprise two longitudinal flanges formed respectively towards the upper and lower edges of the inner face of each of the side walls 151.

Figure 2:
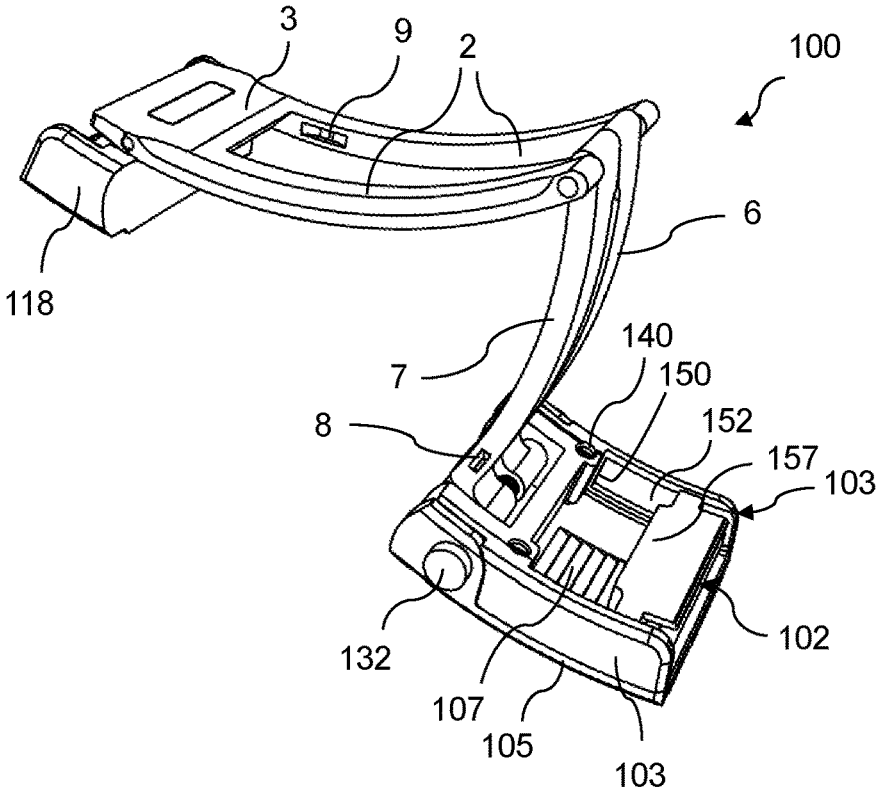
FIG. 2 is a perspective view from below of the clasp of FIG. 1 in the open position.
Figure 4A:
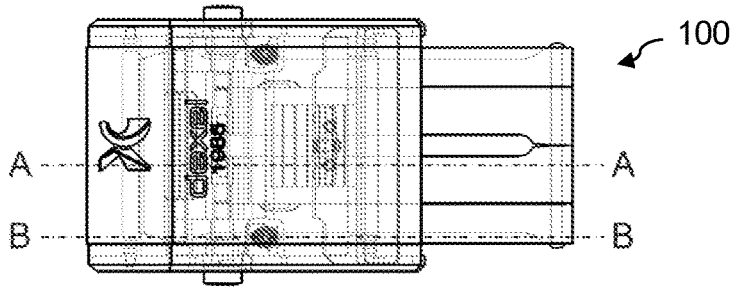
FIG. 4A is a semi-transparent top view of the clasp of FIG. 1, showing the position of sections A-A and B-B of FIGS. 4B-4D and 4E, respectively.

The rails 152 extend substantially in the longitudinal direction and preferably have the same curvature as the side walls 151. Towards a first or rear end of the side walls, the rails 152 are closed to create an end-of-course stop 150 for the movable part 102 in the direction corresponding to the shortening of the length of the band (FIGS. 2 and 4C).

The adjustment device comprises a movable part 102 in the form of a carriage for insertion into and/or between the guide rails 152. To this end, the carriage has two side walls or portions 153, held together by a transversal frame 157. The inner sides of the side portions 153 furthermore serve as a housing for a spring bar which, in the illustrated embodiment, serves as the first attachment member 116. To this end, holes 160 are provided on both sides of the side portions 153, allowing the spring bar 116 to be attached in a conventional manner.

The frame 157 of the trolley has a housing 154 for a locking member 106. This housing 154 is open upwards and arranged to allow the locking member 106 to carry out a linear translation movement along a substantially radial axis, i.e. in the axis of the opening of the housing. Two springs 104 are arranged in the said housing, interposed between bearing surfaces at the bottom of the housing 154 and bearing surfaces arranged in the locking member 106. These springs thus bias the locking member 106 upwards in a direction corresponding to that of the cover 105 in the assembled clasp. A screw or nail 155 anchored in a hole 156 in the locking member prevents the locking member from coming out of the housing. One end of the nail protrudes from a rear face of the locking member to form a plug 158 which is intended to fit into a preferably substantially vertical groove 159, arranged in the housing 154 of the frame 157 (FIG. 4C). As the groove is not open upwards, unlike the housing 154, it forms a limitation to the travel of the locking member 106, when the latter is in its housing 154, as shown in FIGS. 4B to 4D.

When assembling the clasp 100, it is sufficient to insert the assembled movable part 102 into the guide rails 152 through the second end of the frame 103, where these rails are open. The tooth 109 of the locking member 106 comprises an inclined face (or sliding face) which abuts the transversal spacer 148 when a force is applied in the longitudinal direction to the moving part. The force exerted in reaction by the transversal spacer on the inclined face tends to press the whole of the locking member 106 downwards towards the bottom of its housing 154, against the springs 104, thus allowing this member to pass under the transversal spacer 148.

In contrast, once the movable part 102 is inserted, it can no longer move out of its guide rail 152 on the basis of a longitudinally acting force in only, due to the rear face (or blocking face) of the tooth 109, arranged to abut the transversal spacer 148. Thus, the asymmetrical profile of the tooth of the locking member is used to facilitate the assembly of the movable part as described, but also to allow the band to be shortened without the need to activate the activation member 105, as will be described later. The transversal spacer 148 is at the same height as the tooth of the movable part 106, so that it forms an end-of-course stop for the latter in the direction of extension of the band.

FIGS. 4B-4D show a longitudinal cross-sectional view A-A (FIG. 4A) of the clasp 100 and further illustrate the operation of the length-adjustment device, with the locking member 106 and the indexing member 107 shown in longitudinal section.

In the configuration shown in FIG. 4B, the activation member, formed by the cover 105, is in a rest position, in which it is pressed against the support 103, under the effect of the springs 145 (FIG. 4E). On its underside, the cover 105 has a recess 163, preferably transversal, into which the transversal spacer 148 is accommodated when the cover 105 is folded back onto the support.

Even in the rest position, a user can shorten the useful length of the band by exerting a force on the first strand of the band 111 so as to push the movable part 102 in the direction of arrow P in FIG. 4B. In this case, the inclined face of the tooth 109 of the locking member 106 is forced against the inclined face in a complementary manner to a notch in the indexing member 107. This cooperation between the sliding faces generates a reaction force, which, due to the inclinations of the complementary surfaces, has the effect of depressing the locking member 106 into its housing 154. Since the movement in this direction is thus not blocked, the movable part 102 can move in the direction of arrow P in FIG. 4B and thus effect the shortening of the watch band, for example to the position of maximum shortening (not shown), in which the movable part 102 has abutted the closed end 150 of the guide rails 152. In this position, the tooth of the locking member 106 is preferably located in the last of the notches of the indexing member 107, located closest to the first end of the support-cover assembly 103, 105.

It should be noted that although the cooperation between the carriage formed by the movable part 102 and the indexing member does not completely block the movement in the direction of shortening, the carriage is still held elastically in one stable position out of a series of stable positions corresponding to discrete lengths, thanks to the springs 104 and 145, and thanks to the shapes of the tooth 109 and the notches of the rack. In the rest position, these shapes allow contact due to their complementarity, and the nature of these shapes and/or complementarity allows adjustment of the stabilisation of the rest position, as well as the force required to make a movement in the shortening direction.

To effect an extension of the band, the clasp 100 shown in the drawings requires activation of the activation member 105. Due to the profile of the back side of the tooth and the corresponding contact side in the teeth of the indexing member 107, the reaction force when a pulling force is applied to the first strand of the band 111 does not move the movable part 102. Indeed, as the contact faces are substantially vertical, such a traction force generates a reaction force substantially opposite to the traction force, which causes the blocking of the movable part 102.

The user wishing to extend the band pivots the cover 105 counter-clockwise, as shown in FIG. 4D. To do this, the user can pass the angle of a finger under the cover 105 towards the free end (or second end) 162 of the cover, and thereby lift the cover. As a result of this pivoting, the indexing member 107 is separated from the tooth 109 of the locking member 106, the cooperation between the tooth of the movable part 102 and the indexing member is interrupted, the movable part being then completely 102 unlocked. In this activation position (FIG. 4D), the band can be extended, for example by pulling the first band strand and thus moving the movable part 102 in the opposite direction to the arrow P in FIG. 4B. Of course, in this release position, the movable part 102 is free to slide in both directions defined by the guide rail, and the band can therefore also be shortened by lifting the activation member, as illustrated with the double arrow P/T in FIG. 4D.

The locking member 106 is retained in its housing 154 by its plug 158 described above, the movement of which is limited by the extent of the vertical groove 159 arranged in the housing 154 to define a travel stop. The housing 154 further comprises guide rails, visible in FIG. 3, limiting the movement of the locking member 106 to a substantially radial translational movement, allowing cooperation with the indexing member as described above.

FIG. 4E shows that the spring 145, arranged on the screw 146, is compressed between a flange formed by the housing 140 of the screw 146 and the head of the latter. It therefore pushes the screw and the cover 105 down towards the rest position. In the absence of a (slight) force applied by the user to lift the cover/activation member 105, the spring 145, like the springs 104, holds the indexing member 107 and the tooth 109 of the movable part 106 in a cooperating and/or locking position. The housing 140 is large enough to allow the screw 146 to follow the rotational movement of the cover 105, to which it is attached, when the fine-adjustment mechanism is activated. It may be further noted that the extent of pivoting of the activation member 105 with respect to the support or frame 103 is limited by structural elements of the clasp, so as to allow sufficient lifting to enable the aforementioned unlocking, preferably without exposing the movable part 102 too much. For example, a freedom to pivot so as to traverse an angle of 0.1 to 30°, preferably 0.1 to 20°, between the frame 103 and the actuating member 105 is considered sufficient.

The clasp 200 according to the embodiment shown in FIGS. 5 to 8D differs from the first embodiment mainly, firstly, by the arrangement of the indexing member 207 on the movable part 202 and of the locking member 209 on the activation member 205, and, secondly, by the fact that the activation member 205 is part of the cover of the support-cover assembly.

In FIGS. 5 to 12D, the same reference numbers can be used where the geometry and/or general function of a structural element is substantially similar to or identical to the corresponding element of the clasp according to the first embodiment.

The activation member 205 is pivotally arranged with respect to the support 203 of the cover by means of the actuating members 131 (FIG. 3). These elements are in principle identical to those described in relation to the first embodiment and are no longer shown in FIG. 7A. Each of the actuating members 131 is integral with a shaft or cylinder 133, the rotation bearing of which is formed by coaxial lateral holes 243 and 227 arranged in the support 203 and the activation member 205, respectively. In the embodiment shown, the holes 243 and 227 are arranged in a pair of lateral extensions 241 of the support 203 and in a pair of lateral ears 225 of the activation member, respectively. The side extensions 241 are arranged as an extension or part of the side walls 151 of the support 203.

The support 203 has a pair of side walls 151 and at least a portion of the upper wall of the cover. In the embodiment shown, two plates 221 and 223 integral with the side walls 151 of the support 203 form part of the upper wall of the cover.

Between the two plates 221 and 223, the upper wall has an opening 224 in the form of a transversal window. In the assembled clasp, the transversal plate 222 of the activation member 205 covers the opening 224 to complete the upper wall of the cover. The latter is thus formed by three plates 221-223, the plate 222 of the activation member being placed between two transversal plates, respectively front 223 and rear 221, of the support 203, the two plates being integral with the latter. At least one of these transversal plates is required to secure the side walls 151 of the support 203. Thus, one or both of the plates 221 and 223 replace the crossbar(s) 148 and 149 of the first embodiment.

It may be noted that the spacing between the extensions 241 is less than that of the front parts of the two side walls 151, so as to create a niche allowing the ears 225 of the activation member to be placed in the extension of the side walls 151, and thus to give a homogeneous appearance to the cover in the rest position of the activation member, as can be seen in FIG. 5.

As in the case of the clasp according to the first embodiment, a housing 140 is arranged in a protrusion of each of the side walls 151 of the support 203, each housing accommodating a screw 146 and a spring, the end of each screw passing through a hole 144 in the top of the housing to be anchored in a threaded hole 147 in the lower surface of the plate 222 of the activation member 205. A spring 145 is fitted to each of the screws 146 to urge the activation member 205 towards its rest position, in which it is placed on the support 203, and in particular in the opening 224.

Figure 8A:
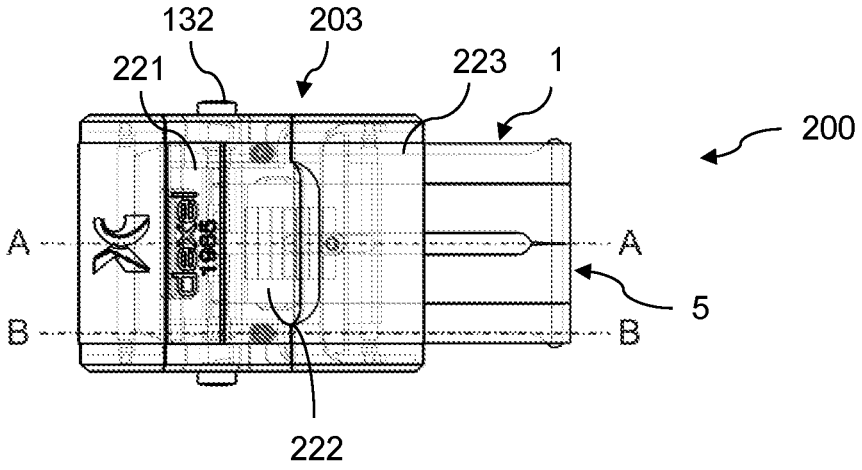
FIG. 8A is a semi-transparent top view of the clasp of FIGS. 5 to 7A.
Figure 8B:
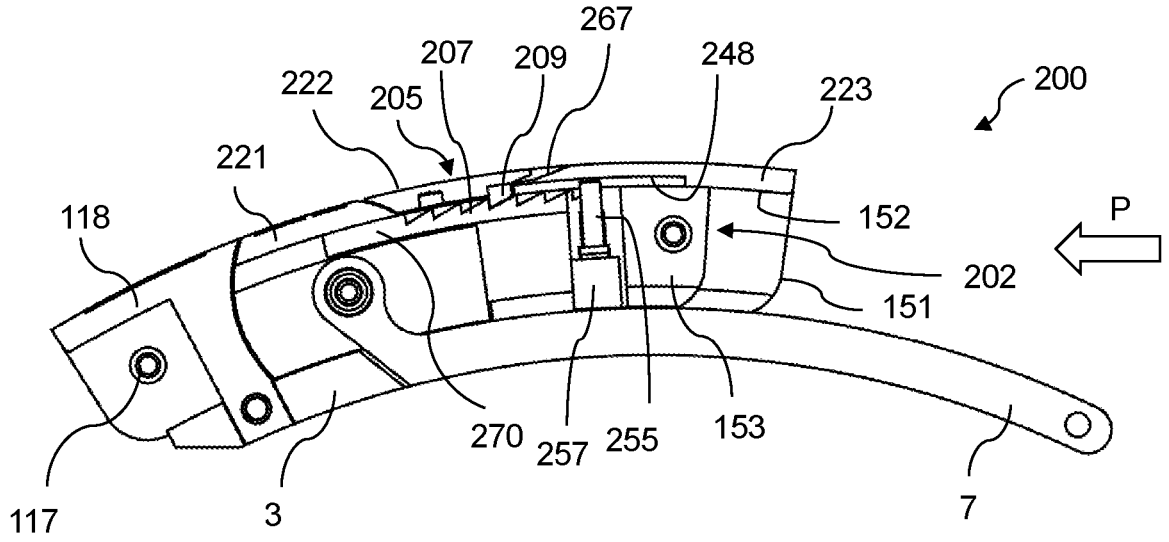
FIGS. 8B, 8C and 8D are longitudinal sectional views, respectively along A-A of FIG. 8A (FIGS. 8B and 8C) and along B-B of FIG. 8A (FIG. 8D), showing the fine adjustment mechanism in the resting (FIG. 8B) and activated (FIGS. 8C and 8D) positions respectively.

The movable part 202 has a pair of side portions 153, which serve both to accommodate a spring bar 116 which constitutes a first attachment member for a first strand of the band 111, and also as sliding shoes to allow the movable part 202 to slide in the two side rails 152 arranged in the inner surface of the side walls 151. The movable part 202 further comprises a plate 270 carrying an indexing member 207 on its upper side. The indexing member 207 may be in the form of a serration or a sequence of notches, for example. A hole 256 is arranged in the plate 270. When the clasp is assembled, the end of a nail 255 housed in the movable part 202 passes through the hole 256 to form a limit stop in cooperation with a limit groove 248 arranged in the plate 223 of the upper wall (FIG. 8B).

Figure 6:
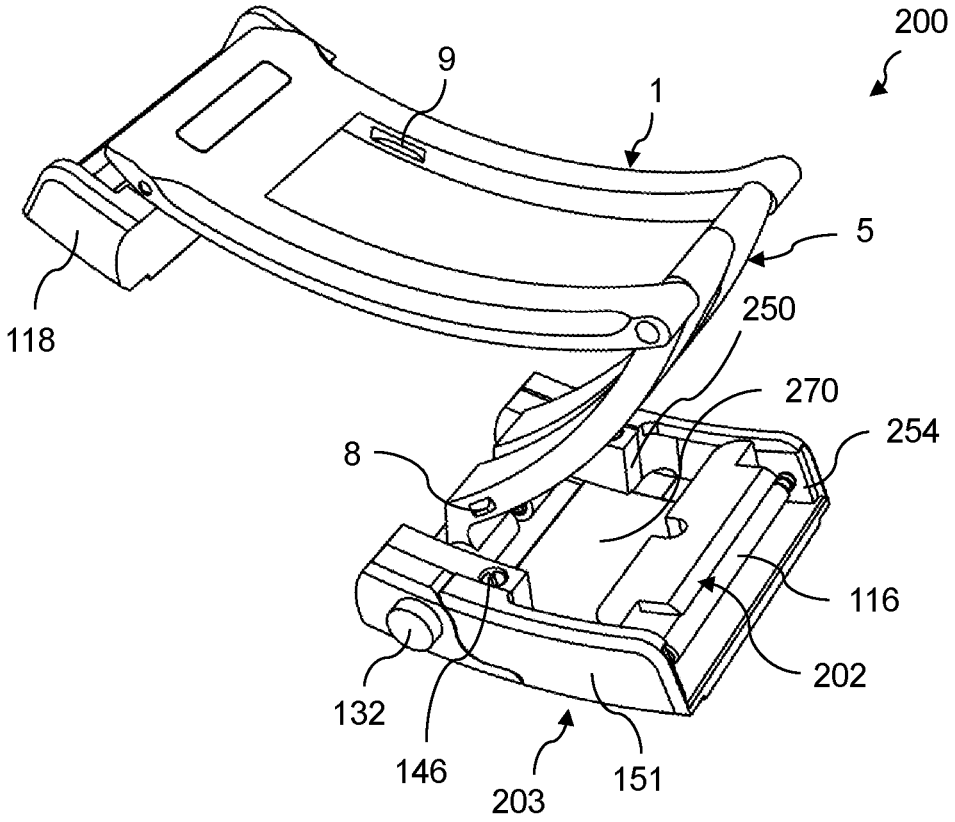
FIG. 6 is a perspective view from below of the clasp of FIG. 5 in the open position.

A locking member 209 in the form of an asymmetrical tooth is arranged on the underside of the plate 222 of the activation member 205. The inclined side of this tooth is visible in FIG. 7B, while the substantially vertical blocking side of the tooth is hidden in this view. A recess 266 is arranged in the underside of the plate 222, in particular of the tooth 209, the purpose of which is to allow the tooth 209 to be placed in the last notch of the indexing member in the position of maximum shortening. The recess then receives the free end of the nail 255 at the end of its travel. In the direction of shortening, the end-of-course stop for the movable part is formed by the stop surfaces 250 arranged in the support 203 (FIG. 6). The frame 257 of the movable part is arranged to abut on these surfaces.

Finally, the activation member 205 comprises a gripping member 264 in the form of an overhang of the free end 262 of the activation member 205. An indentation 265 is also formed in the top plate 223 of the support 203, so as to leave a slot 267 when the plate 222 is placed on the support 203 in its resting position (FIG. 8B).

The operation of the fine adjustment mechanism is illustrated with reference to FIGS. 8B and 8C. In the rest position of the activation member 205, the tooth 209 faces the indexing member 207, so as to be placed and held, preferably elastically, in a notch of the latter. A shortening of the useful length is possible due to the inclined sliding faces of the tooth 209 and the notches of the indexing member. When a user pushes on the first strand of the band 111 as shown by arrow P in FIG. 8B, the inclined face of a notch of the indexing member 207 exerts a force on the inclined face of the tooth 209. Due to the co-operating shapes, this thrust generates a force in the vertical direction, tending the wall 222 of the activation member 105 to lift by rotation of the latter counter-clockwise about the pivot axis formed by the axis 133 of the actuating member 131. The spring 145 (FIG. 8D) is arranged to urge the activation member 205 towards the rest position by acting on the member 205 by means of the screw 146, but allows this lifting due to its elasticity. This allows the movable part 202 to move in the direction of arrow P in FIG. 8B, with the tooth moving to the next notch, in a ratchet-like fashion. A user may continue to shorten the band in this manner, until the movable part 202 is in its end-of-travel position to the left in FIGS. 8B and 8C (not shown), this position being reached when the free end of the nail 255 is placed in the recess 266 in the tooth 209.

In order to extend the useful length, it is not sufficient to pull on the first band strand, because in the embodiment shown, the surfaces of the tooth 209 and of the indexing member 207 which are biased towards each other are arranged to generate a blockage. In the embodiment shown, these surfaces are vertical. A pull in the longitudinal direction has the effect of pressing the two vertical surfaces towards each other without displacement, as described in relation to the first embodiment.

Figure 8C:
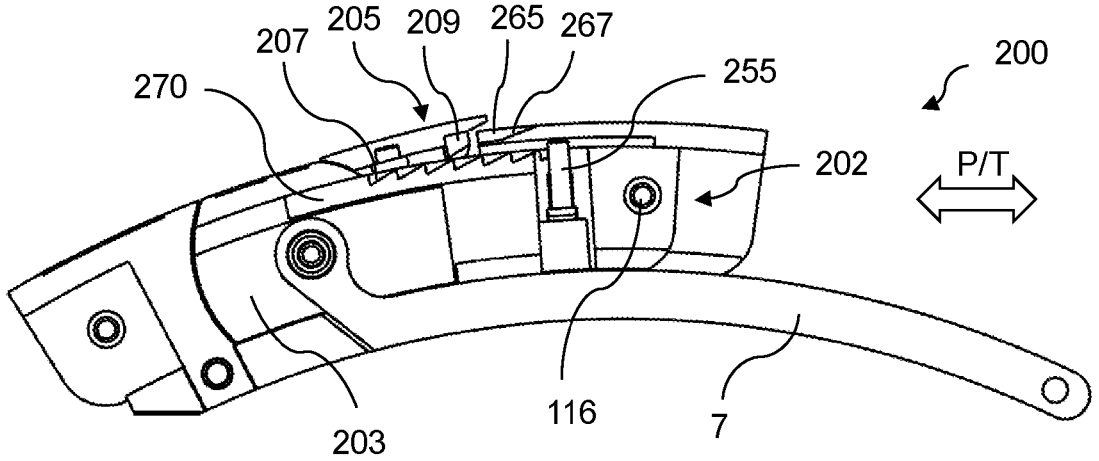
Figure 8D:
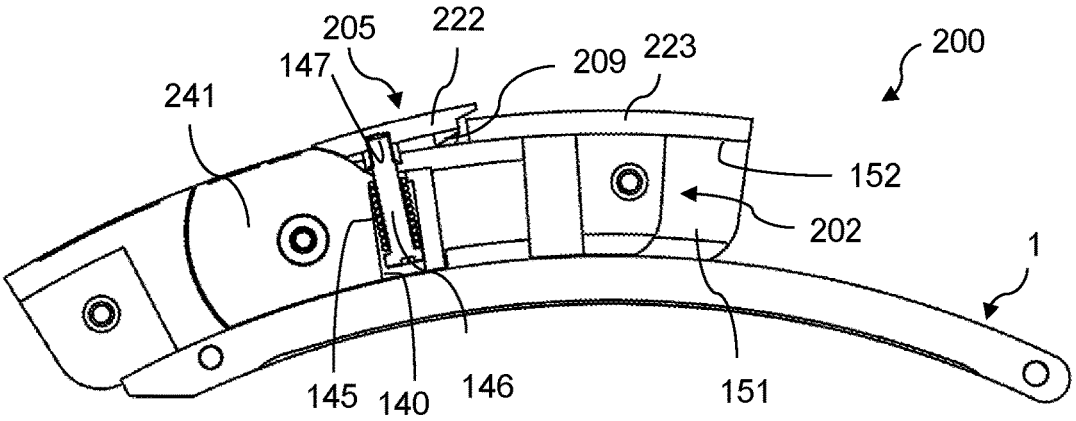

To effect the lengthening of the band, it is then necessary to disengage the tooth 209 from the indexing member 207 by lifting the activation member 205, as shown in FIG. 8C. Conveniently and comfortably, the user can pass a fingertip, such as a finger nail, through the slot 267 formed by the indentation 265 to lift the tab 264 and activate the activation member. In the position shown in FIG. 8C, the movable part 202 is free to move in both directions of the longitudinal direction, determined by the rails 152.

A third embodiment of the invention is illustrated in FIGS. 9 to 12D. The clasp 300 shown in FIG. 9 has a similar or even identical external appearance to the first embodiment (FIG. 1), with an upper wall 126 formed by the activation member 305. A difference from the first embodiment relates to the arrangement of the indexing member 307 on the movable part 302 and the locking member 309 on the activation member 305, as in the case of the second embodiment 200. The transversal spacer 348 serving as an end-of-course stop is arranged to connect the lower edges of the side walls 151 of the frame 303 by passing below the movable part 302. Finally, the crosspiece 349 connecting the side walls 151 of the frame comprises a rail 371, arranged to receive the plate 370 of the movable part 302. This rail 371 has two longitudinal edges, intended to guide the plate 370 to allow it to move only along a substantially longitudinal direction. This movement can be slightly curved, due to the curvature of the frame 303, as mentioned with respect to the first embodiment. In the embodiment shown, the rails 371 are in the shape of an inverted "L", to form an edge that prevents the plate from moving radially. A similar and alternative way (not shown) of guiding the movement of the plate 370 of the movable part 302 would be an opening in the form of a slot in the crossbar 349.

The crossbar 349 has a sliding surface 372 between the rails 371 to allow the plate 370 to slide during the adjustment of the length. It should also be noted that in the embodiment shown, the crossbar 349 also functions as an end-of-course stop for the movable part 302 in the direction of shortening of the useful length.

Figure 12A:
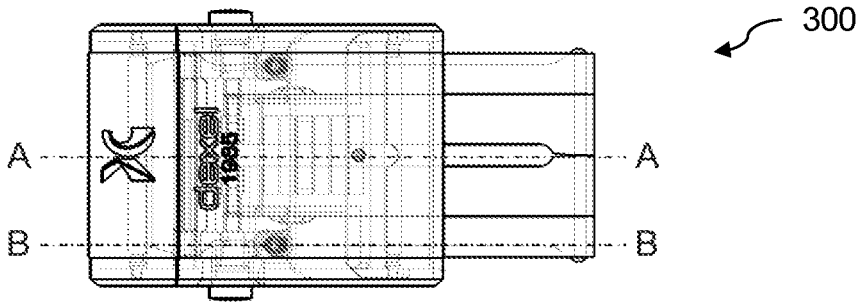
FIG. 12A is a semi-transparent top view of the clasp of FIGS. 9 to 11.
Figure 12B:
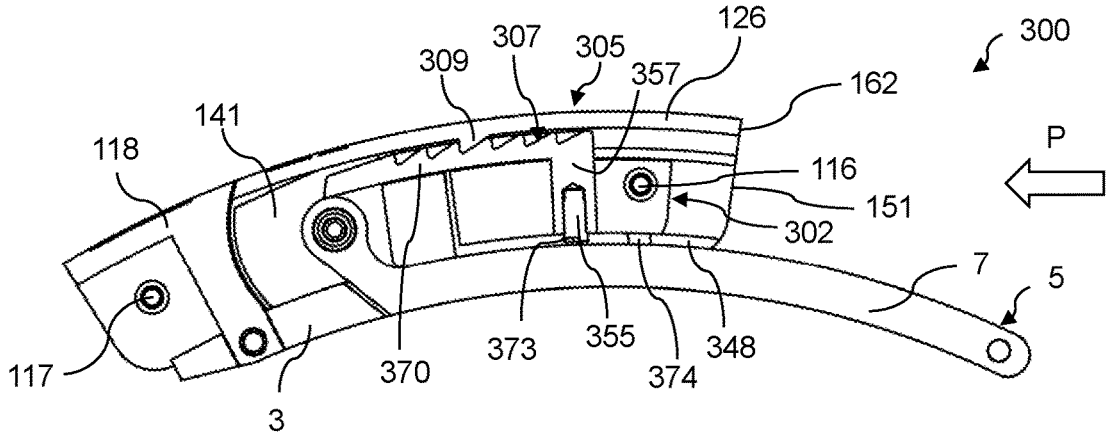
FIGS. 12B, 12C and 12D are longitudinal sectional views, respectively along A-A of FIG. 12A (FIGS. 12B and 12C) and along B-B of FIG. 12A (FIG. 12D), showing the fine adjustment mechanism in the resting (FIG. 12B) and activated (FIGS. 12C and 12D) positions respectively.

The movable part 302 has the general appearance of a "T" and/or a stirrup, in which an orthogonal frame 357 connects the two side portions 153 arranged to allow sliding between the rails 152 in the two substantially longitudinal directions, and the attachment of the attachment member 116 in two holes 160 (FIG. 11) opposite each other of the portions 153. The plate 370 carrying the indexing member 307 on its upper surface is rigidly connected with the frame 357, for example by being formed in one piece with the latter. An end-of-course stop is formed by a nail, screw or bolt 355 inserted into a hole on an underside of the frame 357, so as to form a projection 373 below the frame (FIG. 12B). In the direction of the band extension, this projection abuts the transversal spacer 348, and preferably a recess 374 provided into the spacer 348.

Figure 12C:
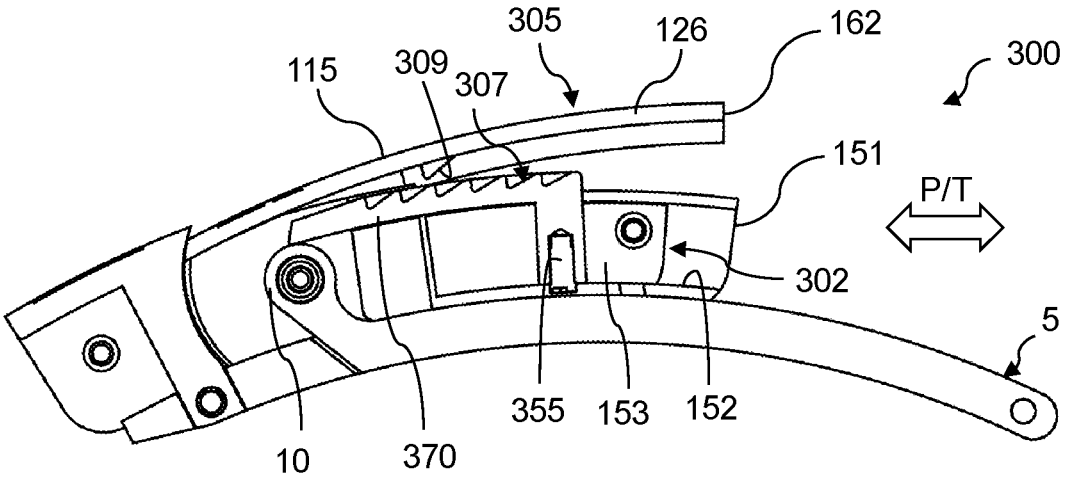
Figure 12D:
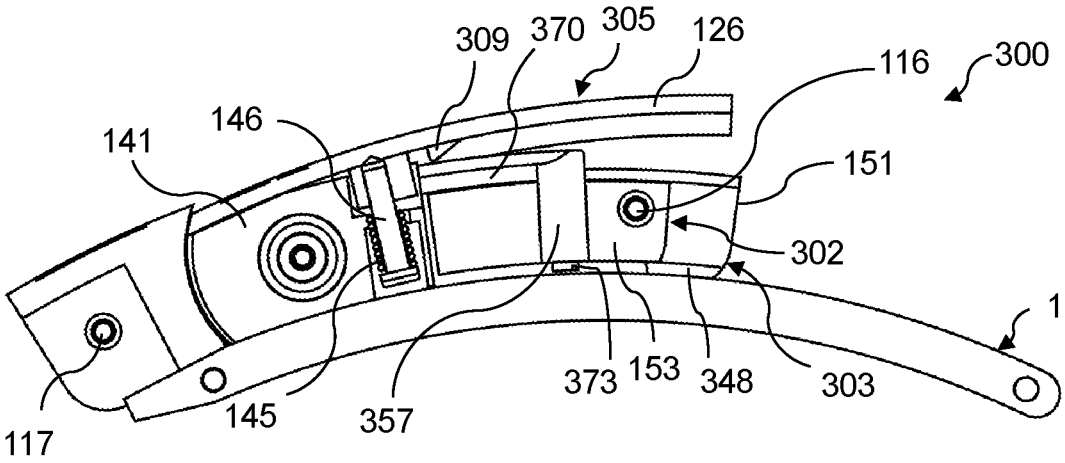

The operation of the fine-adjustment mechanism for the useful length of the clasp 300 is explained with reference to FIGS. 12B and 12C.

In FIG. 12B, a tooth 309 can be seen which is arranged on the underside of the cover 305 and which constitutes a locking member. In the embodiment shown, this tooth is asymmetrical, as in the cases of the locking members of the previous embodiments. The tooth 309 is placed downwardly in a notch in the indexing member 307. The notches of the latter have an asymmetrical profile complementary to that of the tooth. With the activation member 305 shown in the rest position, the user can shorten the useful length by pushing (in the direction of arrow P) on the strand of the band 111 attached to the first attachment member 116, the latter forming part of the movable part 302. Due to the inclined sliding faces of the tooth 309 and/or the notches of the indexing member 307, a substantially vertical reaction force is generated which acts against the springs 145, resulting in a lifting of the activation member (corresponding to the cover) 305, when the indexing member 307 moves in the direction of the arrow P together with the movable part 302. When the tooth 309 moves into the next notch, the cover 305 returns to its rest position. To extend the useful length, it is not enough to pull on the first strand of the band 111. Indeed, due to the opposing, substantially vertical locking faces of the tooth and a notch, pulling on the strand does not produce relative movement between the indexing member 307 and the tooth 309. However, a user may activate the activation member 305, by lifting the lid, preferably by pulling it upwards by its free edge 162. Due to the disengagement of the locking member 309 and the indexing member 307, shown in FIG. 12C, the displacement of the movable part 302 in both longitudinal directions is then possible (double arrow P/T), allowing the user to carry out the lengthening by pulling preferably on the first strand of the band 111, or a shortening by pushing on the latter.

All the clasps 100, 200, 300 allow adjustment without the need to open the clasp, and/or even to remove the wrist watch from the wrist. The useful length can thus be adjusted when a user wears a wrist watch with the clasp on the wrist. Shortening of the useful length can be done without activating the activation member of the fine-adjustment device, by simply pushing one of the two band strands towards the clasp. As far as the extension of the length of the band is concerned, the gesture to activate the activation member is very simple. All it takes is a simple lift. As the activation member is integrated and/or forms part of the cover, in particular the upper and outer wall of the cover, the activation member is easy to access, grasp and activate manually, for example using the angle of a finger as described. Thanks to these features, the length of the band can be finely and precisely adjusted to the wrist size of the wrist watch wearer, quickly and easily, anywhere and/or under any circumstances. This is the functionality of an immediate adjustment to a comfortable length, implemented by the clasp of the invention.

It is worth noting a difference in the clasp 100, according to the first embodiment. In this case, the locking member 106 can move with respect to the movable part 102 due to its housing 154 and the presence of an elastic return member 104. Because of this, when shortening by pushing on the first band strand, the cover and/or activation member 105 is not necessarily forced to lift against the force of the resilient return member 145 to allow movement of the moving part. The presence of two return members 104 and 145 arranged on the movable part 102 and the supports 103, respectively, allows, for example, the shortening without forcing a displacement of the activation member by means of the thrust carried out on the band strand connected to the moving part. In one embodiment, the two means of return 104 and 145 have different return forces. Preferably, the return force of the return member 145 acting on the activation member 105 is higher than the return member 104 acting on the locking (or indexing, as the case may be) member arranged on the movable part 102.

A variation in accordance with the present invention would be to provide an elastic return member, for example in the form of one or more springs, arranged on the movable part (as according to the first embodiment), the latter being provided with a indexing member (as according to the second and third embodiments).

Figure 7A:
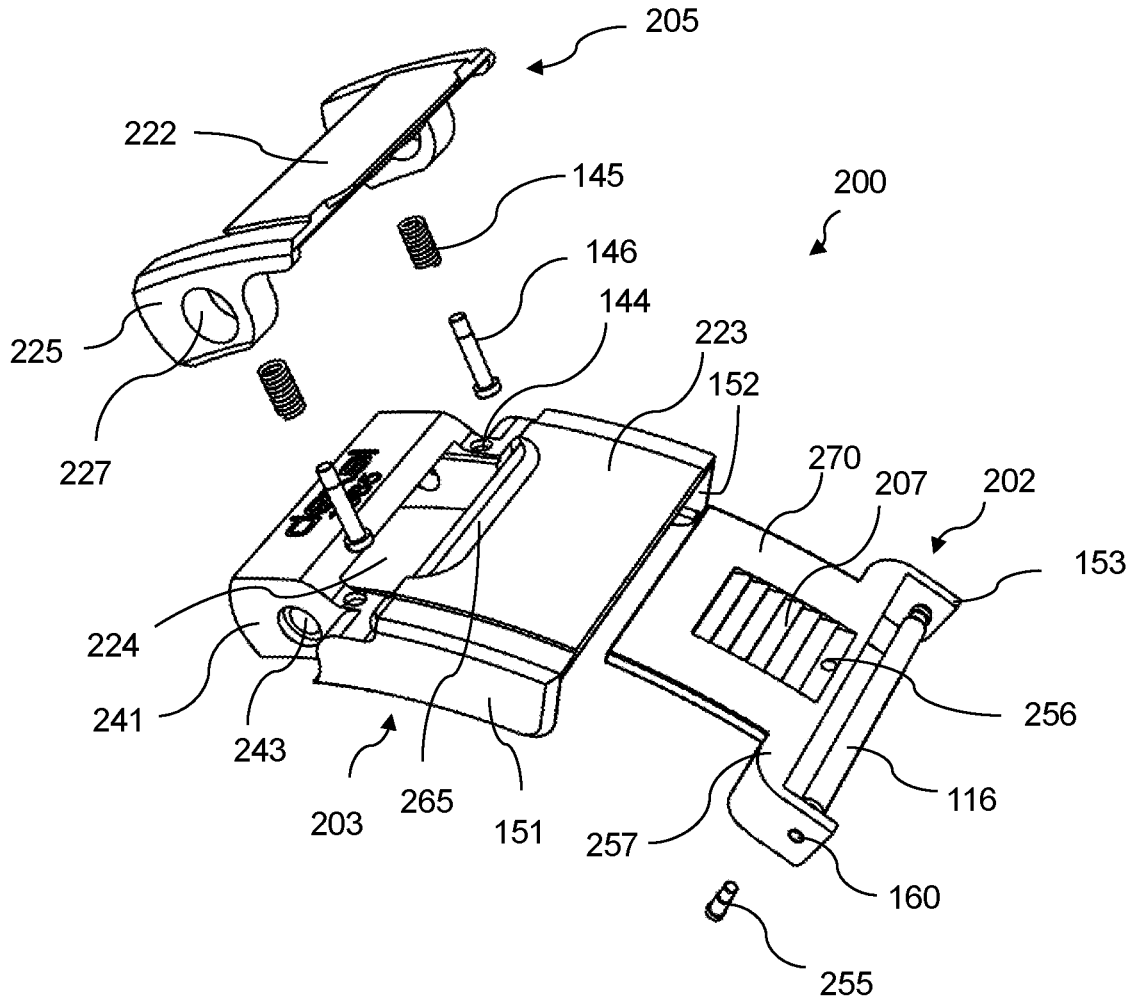
FIG. 7A is an exploded perspective view of the clasp cover of FIGS. 5-6.
Figure 7B:
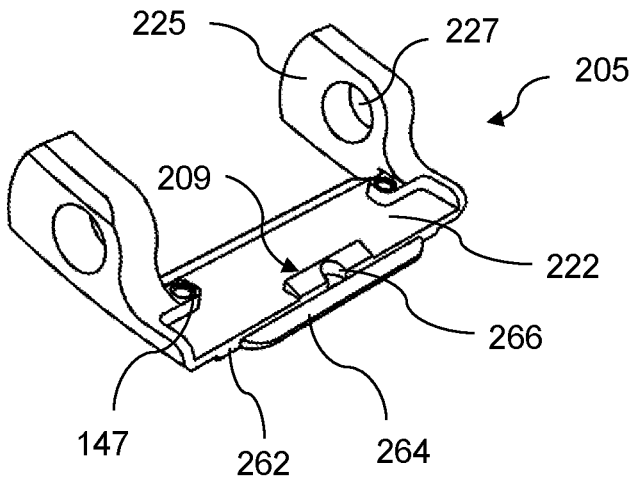
FIG. 7B is a perspective view from below of the actuating member of the clasp of FIGS. 5 to 7A.

The person skilled in the art will understand that it is also possible to easily modify the clasp so as to allow any adjustment, including fine adjustment, only by activating the activation member. For example, it is possible to modify the cooperation surfaces between the locking member and the indexing member so that a displacement of the movable part is blocked in both directions in the absence of an unlocking and/or disengagement of both parts. As described, the activation member can essentially be the cover and/or the top part of the cover, or it can be made as part of the upper wall, for example placed in an opening 224 in the upper wall of the cover (FIG. 7A).

The clasp shown may also be adapted to allow the fine adjustment of length, including lengthening, in the absence of any activation of the activation member, for example by following the teaching disclosed in WO 2019/166671.

Preferably, the activation member of the fine-adjustment device is arranged to be able to pivot about an axis formed by a part or the whole of the actuating member 131 intended to allow the opening of the clasp, the latter preferably comprising at least one lateral pusher, preferably two lateral pushers.

In one embodiment, the activation member of the fine-adjustment device forms a bridge, a loop or a transversal connection connecting, for example, the two side faces of the clasp cover.

The person skilled in the art will not encounter any particular difficulty in adapting the content of the present disclosure to his own needs and in implementing a clasp, in particular for a timepiece, without going beyond the scope of the present invention. For example, the person skilled in the art can adapt the teaching to a pin clasp or a combined clasp (pin clasp/folding blades). In combined clasps, the clasp has folding blades, and at least one attachment member is in the form of a pin clasp. More generally, the length-adjusting device according to the invention can be adapted to other types of clasps, in particular for wrist watches.

The invention claimed is:

1. A clasp of the folding clasp type comprising a device for adjusting the useful length of the band, said device for adjusting the useful length comprising:

a movable part;

a support;

the movable part being arranged to be movable with respect to said support when adjusting the length;

an activation member for activation by a user to effect at least an extension of the band, the device for adjusting the useful length comprising a pivot axis enabling the activation member to pivot with respect to said support when activated, one of said movable part and said activation member comprising a locking member and the respective other comprising an indexing member, said locking member being intended to be positioned in a notch of the indexing member in order to determine a discrete and stable value of the length of the band, wherein the clasp comprises a closing mechanism comprising an actuating member arranged to allow the opening of the clasp, the actuating member being arranged to move one or more selected from the groups consisting of (1) linearly along an orthogonal axis, (2) co-axially to the pivot axis of said activation member, and (3) in parallel to the pivot axis of said activation member.

2. The clasp according to claim 1, comprising a cover comprising or formed by at least two parts, one of the two parts being the activation member and the other being said support.

3. The clasp according to claim 1, wherein the clasp comprises a cover, said cover comprising an upper wall, wherein said activation member comprises a plate forming at least part of said upper wall.

4. The clasp according to claim 3, wherein said activation member is arranged to be activated by lifting said upper wall of the cover and/or at least part of the upper wall of the cover.

5. The clasp according to claim 1, wherein said activation member is integrated in and/or forms an integral part of said cover.

6. The clasp according to claim 1, comprising a pivot axis allowing said activation member to pivot with respect to said support, said pivot axis forming part of at least one actuating member of a closing mechanism of the clasp.

7. The clasp according to claim 6, said at least one actuating member comprising at least one pusher connected to said pivot axis, said actuating member being arranged to move translationally along an orthogonal direction and/or along a co-axial direction to the pivot axis of said activation member with respect to said support device.

8. The clasp according to claim 1, comprising at least one resilient element, arranged to bias the activation member and the support device towards each other and/or to counteract the pivoting of the activation member with respect to the support device.

9. The clasp according to claim 8, wherein said resilient element is arranged in a housing of the support, to act on a pin or a screw anchored in the upper wall of the cover, or in at least a part of said wall, said upper wall preferably forming part of the activation member.

10. The clasp according to claim 8, wherein the housing of said resilient element comprises a hole and/or a bore arranged in said support, said hole or bore preferably extending along a substantially radial direction and/or extending along a direction extending from a bottom to a top.

11. The clasp according to claim 1, wherein said activation member comprising a pair of lateral holes as well as a top plate, each of said lateral holes serving as a guide and/or bearing for a pivot axis of said activation member.

12. The clasp according to claim 1, wherein said support comprises a pair of lateral holes, preferably aligned and/or co-axial with the side lateral of the activation member, each of said lateral holes serving as a guide for a pivot axis for said activation member.

13. The clasp according to claim 1, wherein said movable part comprises a carriage housing said locking member so as to allow said locking member to perform a translational movement in order to be able to cooperate with an indexing member arranged in the upper wall.

14. The clasp according to claim 13, wherein at least one resilient element is arranged in said carriage to exert a force on said locking member so as to bias said locking member towards said indexing member.

15. The clasp according to claim 1, comprising a cover whose upper wall is segmented in the longitudinal direction into several successive parts or segments, said activation member forming a segment or a part of said upper wall.

16. The clasp according to claim 1, which is a folding clasp comprising a folding arm, said folding arm being pivotally connected with said support and/or with said activation member.

17. The clasp according to claim 16, wherein an axis of rotation of said activation member with respect to said support coincides with an axis of rotation of said support and/or of said activation member with respect to said folding arm.

18. The clasp according to claim 16, wherein said folding clasp further comprises a base, wherein said folding arm comprises first and second extremities, wherein said folding arm is pivotally connected to said base at said first extremity and pivotally connected to said support and/or to said activation member at said second extremity.

19. A wrist watch comprising the clasp according to claim 1.

20. The clasp of claim 1, which allows a user to shorten and lengthen the useful length of the band without the need to open the clasp or to remove the wrist watch from the wrist.

21. A folding clasp comprising a device for adjusting the useful length of the band, said device for adjusting the useful length comprising:

a movable part;

a cover comprising or formed by at least an activation member and a support, wherein the movable part is arranged to be movable with respect to said support when adjusting the length, and wherein the activation member is for activation by a user to effect at least an extension of the band, the device for adjusting the useful length comprising a pivot axis enabling the activation member to pivot with respect to said support when activated, one of said movable part and said activation member comprising a locking member and the respective other comprising an indexing member, said locking member being intended to be positioned in a notch of the indexing member in order to determine a discrete and stable value of the length of the band, wherein said cover comprises an upper wall comprising an outer surface which is visible to the wearer of a wrist watch with the clasp, wherein said activation member comprises a plate forming at least part of the upper wall of said cover, and wherein said activation member is arranged to be activated by lifting the upper wall of the cover and/or at least part of the upper wall of the cover.

22. The folding clasp of claim 21, which comprises a folding arm, said folding arm being pivotally connected with said support and/or with said activation member.

23. The folding clasp of claim 21, wherein said activation member is a transversal element of the clasp cover, which connects side faces of the cover.

24. The folding clasp of claim 21, wherein said support comprises a transversal crossbar, which forms and end-of-course stop for said movable part in the direction of extension of the band.

* * * * *